United States Patent [19]

Real

[11] 4,248,151

[45] Feb. 3, 1981

[54] TAPE GUIDE PARTICULARLY USEFUL AS A PRINT STOCK GUIDE FOR IMPACT PRINTERS

[75] Inventor: Kenneth G. Real, Redmond, Wash.

[73] Assignee: Interface Mechanisms, Inc., Lynnwood, Wash.

[21] Appl. No.: 947,461

[22] Filed: Oct. 2, 1978

[51] Int. Cl.[3] ..... B41F 1/08

[52] U.S. Cl. ..... 101/288; 226/196; 271/251

[58] Field of Search ..... 101/327, 288; 226/196, 226/182, 184; 242/76; 271/248, 250, 251, 252

[56] References Cited

U.S. PATENT DOCUMENTS

| | | | |
|---|---|---|---|
| 2,012,130 | 8/1935 | Kellogg | 226/196 |
| 2,674,456 | 4/1954 | Gibson | 271/251 |
| 2,916,228 | 12/1959 | Wellington | 242/76 |
| 3,929,327 | 12/1975 | Olson | 271/250 |
| 4,011,814 | 3/1977 | Real | 101/288 |

OTHER PUBLICATIONS

IBM Technical Disclosure Bulletin, Paper Feed Aligner Mech., G. D. Anderson, vol. 15, No. 4, Sep. 1972, p. 1253.

*Primary Examiner*—Edward M. Coven
*Attorney, Agent, or Firm*—Christensen, O'Connor, Johnson & Kindness

[57] ABSTRACT

A guide which maintains an edge surface of a tape, such as an elongated strip of print stock, in contact with a reference surface formed on a base of the guide as the tape is moved in a predetermined direction and along a predetermined path. Preferably, the guide includes a first roller which is mounted on the base in proximity to the reference surface and which has an axis of rotation which is inclined, in an imaginary plane parallel to the predetermined direction of tape movement, from a normal drawn to the reference surface. A second roller is also mounted on the base in proximity to the reference surface and has its axis of rotation substantially parallel to that of the first roller, with corresponding portions of the peripheral surfaces of the first and second rollers being in proximity to each other to define a nip therebetween for compressing the tape. A stock sensor is supported in the base and defines a slot which is aligned with the nip of the first and second rollers, with a light source and a light sensor being disposed in portions of the stock sensor defining the slot and opposing each other across the slot.

2 Claims, 5 Drawing Figures

Fig. 3.
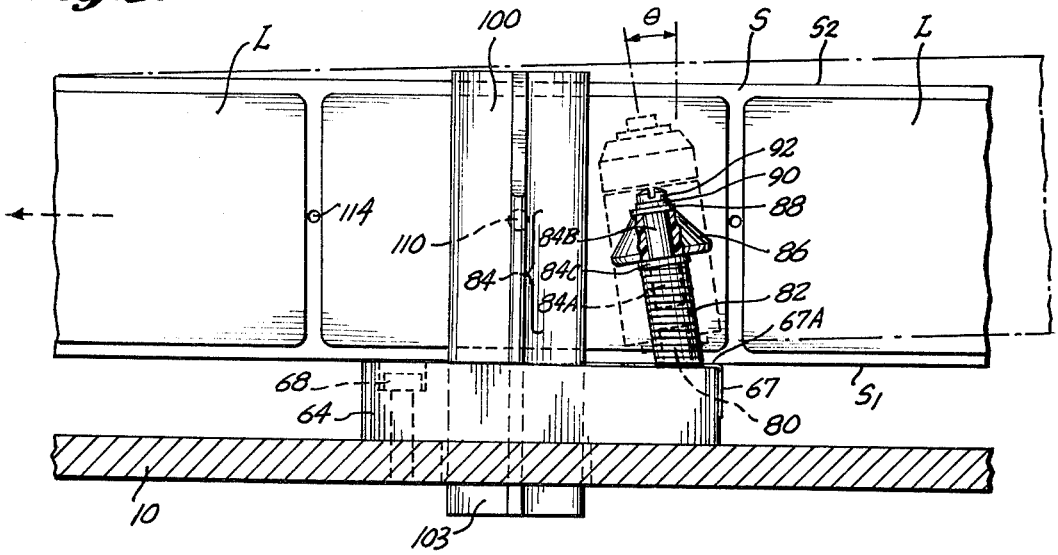
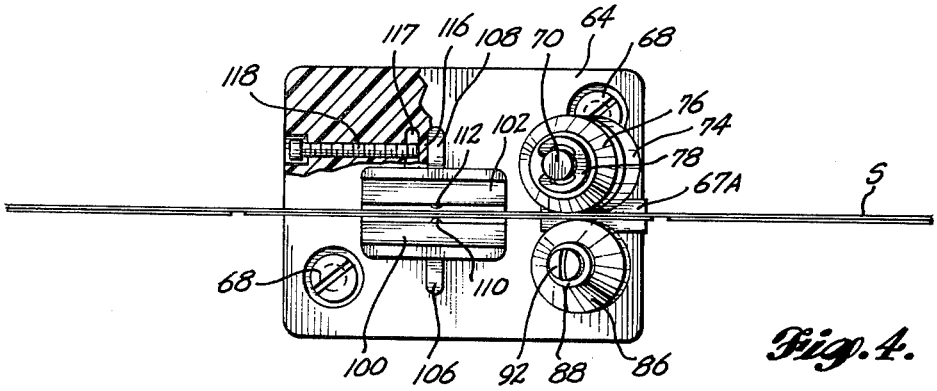
Fig. 4.
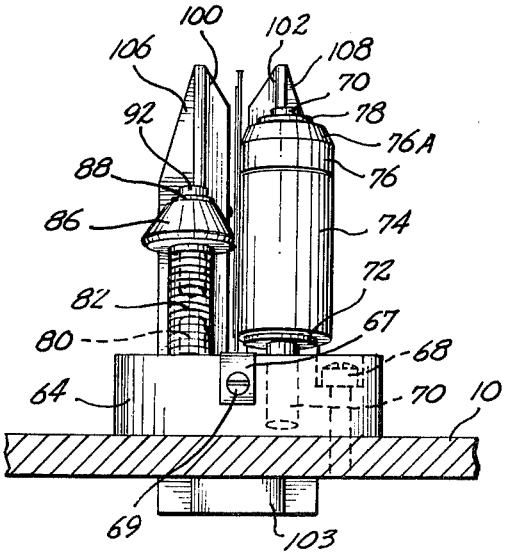
Fig. 5.

TAPE GUIDE PARTICULARLY USEFUL AS A PRINT STOCK GUIDE FOR IMPACT PRINTERS

FIELD OF THE INVENTION

This invention generally relates to the field of the tape guides, and, more specifically, to a tape guide particularly useful as a print stock guide for printing apparatus including mechanical impact printers.

BACKGROUND OF THE INVENTION

Mechanical impact printers are known to the prior art for imprinting a succession of characters, which may be expressed in the form of a bar code or the like, on print stock which typically comprises a succession of labels removably adhering to an elongated strip of label stock backing. In such printers, the elongated strip is moved under tension along a predetermined path through a print station where the characters are successively printed. The print station may include a continuously rotating, cylindrical print wheel having located on a circumferential surface thereof a plurality of raised elements representing the characters to be imprinted, and a hammer mechanism including a hammer which has a selectively controllable, reciprocative movement in a predetermined, imaginary plane, whereby the hammer during its travel impacts the elongated strip and an interposed ink ribbon against one of the elements of the print wheel, resulting in imprinting of a single character.

To insure accurate and precise registration of successive characters on each label in a horizontal direction, or parallel to the direction of elongation of the print stock, the label stock backing must be vertically aligned with the print station including the print wheel and the hammer mechanism as the label stock backing is moved through the print station. In the prior art, this alignment has been accomplished by the provision of a horizontal reference surface, which defines a plane extending at right angles to the plane of reciprocative movement of the hammer, and against which the lower edge surface of the label stock backing bears during imprinting and print stock movement. It has been found, however, that the label stock backing will tend to rise or otherwise shift in a vertical direction from the horizontal reference surface during horizontal movement, with resulting misregistration of successive characters on a label.

A print stock guide is taught in U.S. Pat. No. 4,011,814, Real, issued on Mar. 15, 1977 to the assignee of the present invention, which serves to maintain the vertical alignment of an elongated strip of print stock as the print stock is moved through the print station of an impact printer. In U.S. Pat. No. 4,011,814, a horizontal reference surface is provided in proimity to the print station, and a guide means is located in proximity to the print station between a supply position of the print stock and the print station for urging a lower edge surface of the print stock into contact with the horizontal reference surface as the print stock is moved by the impact printer along a predetermined path. The guide means includes a first guide surface located in proximity to the supply position and having a predetermined angle of inclination with respect to a normal drawn to the horizontal reference surface, in an imaginary plane transverse to the predetermined path of print stock movement. The guide means also includes a second guide surface located intermediate the first guide surface and the print station and having a substantially zero angle of inclination with respect to a normal to the horizontal reference surface, with the first and second guide surfaces being located with respect to the predetermined path so as to remain in contact with one of the front or back surfaces of the print stock during print stock movement.

A prime disadvantage of the guide means taught in U.S. Pat. No. 4,011,814 is that careful attention must be paid to its design for a specific impact printer installation in order to insure that the guide means will in fact urge the lower edge surface of the print stock into contact with the horizontal reference surface. For example, a stiffer print stock, or a print stock having a higher coefficient of friction, than that for which the guide means was designed may not remain in contact with the first or inclined guide surface during movement of the print stock, with a result that the print stock will shift vertically.

Also, the rate at which the print stock is driven towards the horizontal reference surface is directly dependent upon the rate of movement of the print stock past the guide surfaces, with the result that the print stock may not be vertically aligned with respect to the print station when the print stock is moving relatively slowly as during imprinting.

Another disadvantage of the guide means taught in U.S. Pat. No. 4,011,814 is that the guide means must be interposed in the predetermined path of print stock movement so that the guide surfaces thereof remain in contact with one of the front or back surfaces of the print stock, and therefore deflect the print stock slightly from its predetermined path. Such deflection produces a significant amount of drag on the print stock which must be accommodated by increasing the power of the mechanism that moves the print stock under tension through the print station.

Finally, impact printers are in many cases installed so that the reference surface is vertical instead of horizontal. In such cases, it has been found that the shift in the line of action of gravity forces acting on the print stock may cause the guide means to fail to operate.

It is therefore an object of this invention to provide an improved guide means for an impact printer which serves to urge an edge surface of an elongated strip of print stock into contact with a reference surface so as to maintain the alignment of the elongated strip relative to a print station including a hammer mechanism and a continuously rotating print wheel.

It is a further object of this invention to provide such a guide means which serves to maintain the relative alignment of the elongated strip of print stock with respect to the print station, irrespective of the spatial orientation of the reference surface, of the speed at which the print stock is transported through the print station, or of the type or size of print stock that is used.

It is another object of this invention to provide such a guide means which does not significantly increase the drag on, and therefore the tension in, the print stock as the print stock is transported through the print station.

It is a basic object of this invention to provide a tape guide, particularly useful as a print stock guide for impact printers, which maintains an edge surface of a tape in contact with a reference surface as the tape is moved in a predetermined direction and along a predetermined path.

SUMMARY OF THE INVENTION

The foregoing objects, as well as additional objects and advantages that will be apparent to those or ordinary skill in the art, are achieved in a tape guide which is adapted to urge an edge surface of a tape into contact with a reference surface as the tape is moved in a predetermined direction and along a predetermined path. The tape guide comprises first means located adjacent one side of the predetermined path of tape movement, the first means having a first peripheral surface which is supported for rotation about an axis which is inclined, in an imaginary plane parallel to the predetermined direction of tape movement, from a normal drawn to the reference surface. The tape guide also comprises a second means having a second peripheral surface which is supported for rotation about an axis which is substantially parallel to the axis of rotation of the first peripheral surface, with at least a portion of the second peripheral surface being located in proximity to at least a portion of the first peripheral surface to therefore define a nip for compressing the tape therebetween.

The invention finds particular applicability in printing apparatus such as impact printers which use print stock comprising an elongated strip having opposing first and second edge surfaces. Such an impact printer includes: a print station for imprinting characters on the print stock; print stock drive means for moving the print stock in a predetermined direction and along a predetermined path from a supply position to the print station; and, reference guide means located in proximity to the print station, the reference guide means having a reference surface whose location is fixed with respect to the print station so as to print stock to be aligned with respect to the print station. In such a case, the tape guide may be embodied in a print stock guide which is adapted to urge one of the first and second edge surfaces of the print stock into contact with the reference surface upon print stock movement.

In a preferred embodiment, the reference surface is substantially planar and is incorporated in a base of the guide. A first roller means is mounted on the base and has a first peripheral surface which is supported for rotation, in proximity to the reference surface, about an axis which is inclined in a predetermined direction by an angle $\theta$ from a normal drawn to the reference surface. A second roller means is also mounted on the base and has a second peripheral surface which is supported for rotation, in proximity to the reference surface, about an axis substantially parallel to the axis of rotation of the first peripheral surface, with at least a portion of the second peripheral surface being in proximity to at least a portion of the first peripheral surface to define a nip therebetween.

A stock sensor is supported in the base in proximity to the reference surface, the stock sensor comprising: first and second opposing, spaced-apart surfaces defining therebetween a slot which is aligned with the nip of the first and second peripheral surfaces; a light source disposed in the first surface of the sensor at a predetermined distance above the reference surface; and, a light sensor disposed in the second surface of the stock sensor at that predetermined distance above the reference surface and in opposing relationship to the light source.

BRIEF DESCRIPTION OF THE DRAWINGS

The invention can best be understood by reference to the following portion of the specification, taken in conjunction with the accompanying drawings in which:

FIG. 3 is a front elevational view of the improved guide means;

FIG. 4 is a top plan view of the improved guide means; and,

FIG. 5 is a right side elevational view of the improved guide means.

DESCRIPTION OF A PREFERRED EMBODIMENT

Figure 1:
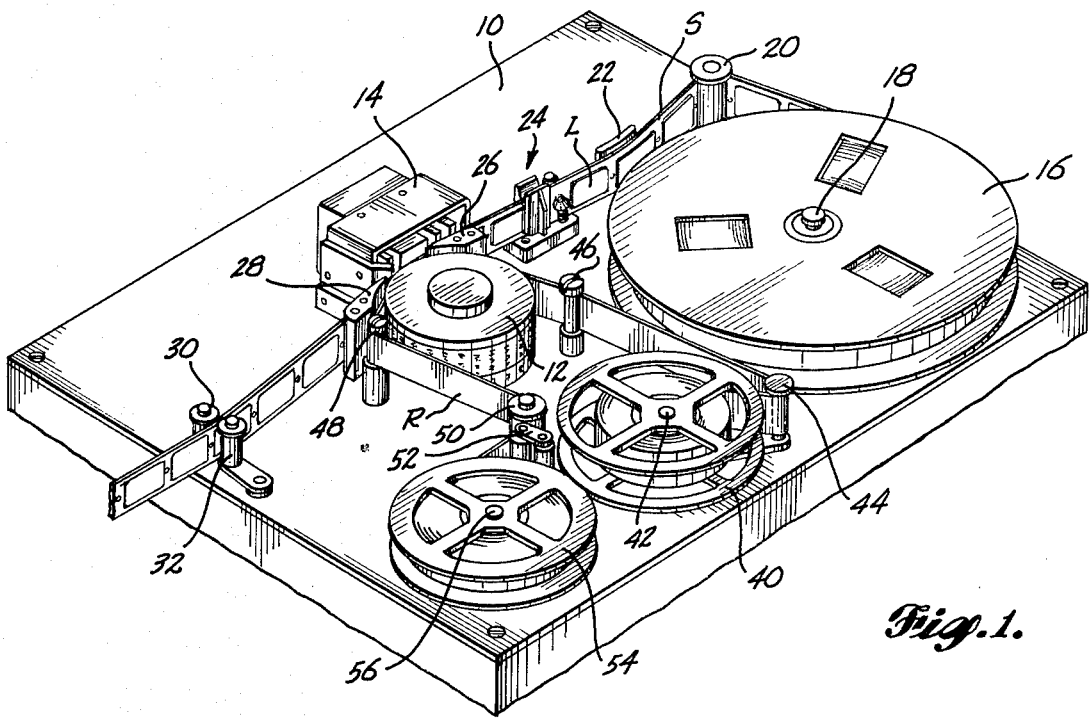
FIG. 1 is a pictorial view of an impact printer including the improved guide means of the present invention.
Figure 2:
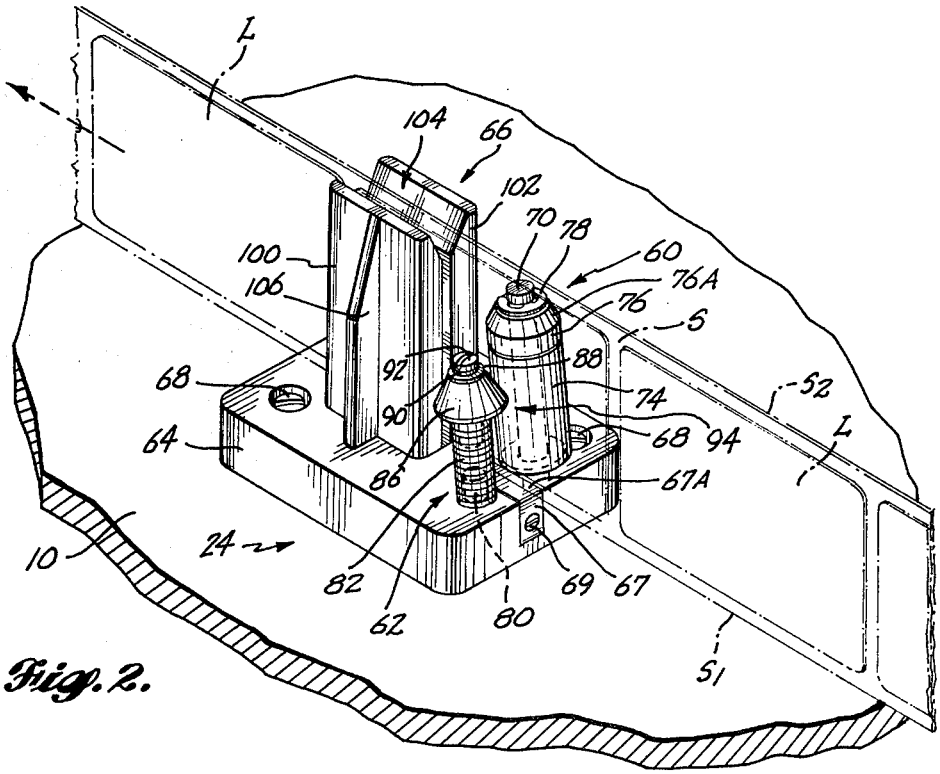
FIG. 2 is an enlarged pictorial view of the improved guide means.

Referring now to FIG. 1, an impact printer includes a base plate 10 above which a print wheel 12 is supported for rotation. The circumferential surface of print wheel 12 has located thereon a plurality of raised elements representing the characters to be imprinted, with the print wheel 12 being continuously rotated by a drive means, not illustrated. A hammer mechanism 14 is located in proximity to the print wheel 12 and together with print wheel 12 forms a print station. The hammer mechanism 14 includes at least one hammer which is capable of a controllable, substantially reciprocative movement whereby a hammer face thereof impacts a back surface of an elongated strip of label stock backing S to press one of a plurality of labels L, removably adhering to a front surface of the backing S, and an interposed ink ribbon R against one of the raised elements on the print wheel 12 to thereby imprint a character on the label L.

The print stock including the label stock backing S is obtained from a print stock supply reel 16 which is rotatably supported on a shaft 18 mounted on a subplate (not illustrated) below base plate 10. From the print stock supply reel 16, the print stock is first drawn around a supply tension roller 20 supported on a lever arm (not illustrated) which is mounted on base plate 10, and from there moves in a predetermined path past a guide member 22, a guide member 24 including the present invention, and a guide member 26 to the print station. Immediately after leaving the print station, the print stock moves in a predetermined path by being drawn over a guide member 28 and thereafter is pressed against a drive capstan 30 by an associated pinch roller 32, and then exits from the impact printer. The drive capstan 30 is rotated by a drive capstan motor, not illustrated, mounted below the base plate 10. During its passage through the impact printer from the supply reel 16 to the drive capstan 30, the print stock is maintained under tension by the tension roller 20 acting against the force exerted on the print stock by the drive capstan 30.

The ink ribbon R is obtained from a ribbon supply reel 40 which is rotatable on a shaft 42 mounted on base plate 10. From the ribbon supply reel 40, the ink ribbon R passes around a supply tension roller 44, supported on a lever arm (not illustrated) which is mounted on base plate 10, and around a guide pin 46 and through the print station and around a guide pin 48, with guide pin 46 and guide pin 48 being mounted on base plate 10. From guide pin 48, the ink ribbon R passes around a drive capstan 50 which is rotated by a drive capstan motor, not illustrated, and is passed against drive capstan 50 by a pinch roller 52 mounted on base plate 10. From drive capstan 50, the ink ribbon R is taken up on a ribbon take-up reel 54 which is rotatable with the shaft 56 of a ribbon driver motor, not illustrated.

As is conventional in the prior art, electronic control means is provided for controlling and coordinating the rotation of drive capstans 30, 50 to provide movement of the print stock and the ink ribbon through the print station. Electronic control means is likewise provided for coordinating the movement of the hammer within the hammer mechanism 14 with the rotation of print wheel 12 under control of timing signals obtained from print wheel 12 to provide imprinting of selected characters in succession on the labels L removably adhering to the label stock backing S.

Since the raised elements on the print wheel 12 and the hammer in hammer mechanism 14 are each maintained at a predetermined distance above the base plate 10, it can be seen that the print stock including the label stock backing S must also be maintained at a predetermined distance above the base plate 10 during its movement through the print station in order that successive characters on each label be aligned with each other. This predetermined distance is established by a reference surface which is located in proximity to the print station and whose position is fixed with respect to the base plate 10. The present invention is embodied in the guide member 24 which is adapted to urge the edge surface of the print stock which is closest to the base plate 10 into contact with the reference surface upon movement of the print stock towards the print station, irrespective of the spatial orientation of the base plate 10, and therefore of the reference surface, or of the speed at which the print stock is moved toward the print station, or of the type or size of print stock.

Referring now to FIGS. 2–5, the embodiment of the guide member 24 illustrated therein includes a first roller means 60 and a second roller means 62, both of which are supported for rotation on a base 64. A stock sensor 66 is also supported on base 64. A metallic insert 67 is located in a notch formed on one end of base 64 and adjacent first and second roller means 60, 62, with insert 67 being secured to base 64 by a fastener 69 and having a substantially planar reference surface 67A. Base 64 is secured to base plate 10 by a plurality of fasteners 68 at a location in proximity to the print station including print wheel 12 and hammer mechanism 14 and intermediate the print station and a supply position for the print stock, e.g., a position in proximity to guide member 22, so that the reference surface 67A is located in the predetermined path of print stock movement. Specifically, the label stock backing S, having a first edge surface S1 in closest proximity to the base plate 10, and a second, opposite edge surface S2, travels from the supply position, through the first and second roller means 60, 62, through the stock sensor 66 and then to the print station, with the first and second roller means 60, 62 being adapted to urge the first edge surface S1 into contact with the reference surface 67A.

The first roller means 60 includes an elongated pin 70 which is press-fit or otherwise secured in a corresponding aperture located in base 64 and to one side of the insert 67. As best seen in FIGS. 3 and 4, the pin 70 extends above the reference surface 67A so that the longitudinal axis of pin 70 is inclined, in an imaginary plane substantially parallel to the direction of print stock movement, by an angle $\theta$ from a normal drawn to the reference surface 67A. As best seen in FIG. 5, the longitudinal axis of the pin 70, in an imaginary plane transverse to the direction of print stock movement, has a substantially zero angle of inclination with respect to a normal drawn to the reference surface 67A. Adjacent base 64, a retaining ring 72 is provided on pin 70 which limits the travel of an elongated roller 74, itself rotatively supported on pin 70, toward base 64. Roller 74 may be formed from polyurethane, or like material having a relatively high coefficient of friction, and may include a central, metallic bearing, not illustrated. Rotatably supported on pin 70 above roller 74 is a cap 76, which may be formed from an acetyl resin or like material having a relatively low coefficient of friction. The diameter of cap 76 is substantially equal to that of roller 74 and the upper portion 76A of cap 76 is chamfered. A snap ring 78 is received at a corresponding groove at the top of pin 70 to maintain roller 74 and cap 76 thereon.

The second roller means 62 includes a pin 80 which projects above base 64 at a side of insert 67 opposite from pin 70. As best seen in FIGS. 3, 4 and 5, the longitudinal axis of pin 80 is substantially parallel to the longitudinal axis of pin 70. An elongated coil spring 82 has a first end fit onto pin 80 so that the undeflected longitudinal axis of coil spring 82 is substantially parallel to the longitudinal axis of pin 70. A pin 84, having first and second ends 84A, 84B and an intermediate, enlarged shoulder 84C (FIG. 3), has its first end 84A press-fit into a second end of coil spring 82. A tapered roller 86, which may be composed of an acetyl resin, is supported for rotation on the second end 84B of pin 84, and rests upon the shoulder of 84C thereof, with tapered roller 86 being retained on pin 84 by a washer 88, a lock washer 90, and a screw 92 which is received in second end 84B. The largest diameter of tapered roller 86, together with the location of pin 80 relative to pin 70, are chosen so that a peripheral surface of taped roller 86 is in proximity to a corresponding portion of the peripheral surface of roller 74 to define therebetween a nip 94 (FIG. 2) for compressing the print stock.

In use, the elongated strip of label stock backing S is inserted into the nip 94 between the first and second roller means 60, 62, with insertion being facilitated by the taper on roller 86, the chamfered surface 76A on cap 76, and the relatively low coefficients of friction of the materials of cap 76 and tapered roller 86. The coil spring 82 therefore causes the tapered roller 86 to press the elongated strip of label stock backing S against the roller 74 and the cap 76. As the label stock backing S is thereafter moved along its predetermined path from the supply position to the print station under control of the impact printer as previously described, it will be seen that roller 74, cap 76, and tapered roller 86, due to their inclination in the direction of movement of the print stock, drive the label stock backing S towards the base 64 until the edge surface S1 thereof comes into contact with the reference surface 67A. Upon further movement of the print stock from the supply position to the print station, the forces exerted by roller 74, cap 76 and tapered roller 86 counteract any forces otherwise exerted on the label stock backing S that would cause the edge surface S1 thereof to move away from contact with the reference surface 67A.

Preferably, the material of tapered roller 86 has a lower coefficient of friction than that of roller 74 so that tapered roller 86 can slip relative to the label stock backing S upon movement thereof, so as to avoid crimping or otherwise distorting the edge surface S1.

Since both the first and second roller means 60, 62 are inclined in the direction of movement of the print stock, it will be seen that they will drive the print stock towards the reference surface 67A no matter what the spatial orientation of that reference surface. Further, the supporting of the tapered roller 86 on a flexure such as the coil spring 82, and the compressing of the print stock between the tapered roller 86 and the roller 74 and cap 76, allow such an operation to occur, nothwithstanding the thickness or surface characteristics of the print stock or the speed at which the print stock is moved.

For most applications, a preferred value of the angle $\theta$ of inclination of the first and second roller means 60, 62 is 10°, although it should be emphasized that this value is not critical and that any nonzero value will cause the first and second roller means 60, 62 to drive the print stock towards the reference surface 67A. As the value of the angle $\theta$ is increased, the forces exerted on the print stock to drive the print stock towards the reference surface 67A also increase. As these forces increase, the tendency of the edge surface in contact with the reference surface to crimp or otherwise distort also increases, so that there is a maximum limit upon the value of the angle $\theta$ that should be determined empirically.

It is not necessary that the heights of the first and second roller means 60, 62 above the base 64 have any predetermined relationship to each other or to the height of the print stock, as only a very small portion of the print stock need be compressed between the first and second roller means 60, 62. It may be desirable, however, that the print stock be substantially normal to the reference surface 67A when it exits from the first and second roller means 60, 62. For this purpose, at least the first roller means 60 should have a height which is a substantial portion of the height of the print stock, and the first and second roller means should have their longitudinal axes normal to the reference surface 67A, in an imaginary plane transverse to the direction of print stock movement. Since the guide means of the present invention does not require that the guide means be interposed in the predetermined path of print stock movement so as to deflect the print stock, it will be seen that the guide means provides substantially lower drag than those of the prior art.

It will also be appreciated that the guide means of the present invention may be configured so as to drive the edge surface S2 into contact with a reference surface located above the print stock. In this case, the first and second roller means 60, 62 will be inclined, in an imaginary plane substantially parallel to the direction of print stock movement, by an angle $\theta$ drawn to the reference surface in a direction opposite to the direction of print stock movement.

The design of the guide means permits the stock sensor 66 to be easily incorporated therein. The stock sensor 66 comprises an elongated, substantially rectangular block which has a lower end 103, and which is bifurcated at its upper end into first and second halves 100, 102 having opposing surfaces which define therebetween a slot 104 which is aligned with the nip 94. An elongated rib 106 is provided on and extends parallel to the longitudinal dimension of half 100 and a longitudinal rib 108 is provided on and extends parallel to the longitudinal dimension of half 102. The stock sensor 66 is received in a corresponding aperture in base 64 which is located adjacent to the insert 67, with the aperture being defined by surfaces of base 64 which are generally complementary to corresponding surfaces of stock sensor halves 100, 102 and ribs 106, 108. Within slot 104, a light source 110 is mounted in half 100, and an opposing light detector 112 in half 102.

The primary purpose of stock sensor 66 is to detect the position of each label L on the label stock backing S. Typically, an indicia is placed on the label stock backing S between adjacent labels L, such as perforations 114, or notches formed adjacent to one of the edge surfaces S1, S2. In each case, the light source 110 and light detector must be precisely maintained at the expected location of such indicia, so that the passage of such indicia past the light source 110 and light detector 112 results in a change in an output signal from light detector 112. Accordingly, the proximity of the stock sensor 66 to the guide means of the present invention permits such indicia to be accurately and repeatably sensed, since the light source 100 and light detector 112 may be maintained at a predetermined distance above the reference surface 67A and since the guide means of the present invention will maintain the edge surface S1 of the label stock backing S into contact with the reference surface 67A. Since the location of the indicia on the print stock with respect to the edge surface S1 thereof may vary, depending on the type of print stock, the location of the light source 110 and light detector 112 may be selectively adjusted with respect to the reference surface 67A by moving the stock sensor 66 upwardly or downwardly with respect to the base 64. In order to maintain the stock sensor 66 in a predetermined position with respect to the base 64, a wall 116 is provided within base 64, with wall 116 being defined by the surface of the aperture through base 64 which is complementary to a portion of the rib 108, and by a separate, spaced-apart notch 117. A screw 118 is received in an aperture extending from an exterior surface of base 64 into the notch 117, with the screw 118 being threaded so that its end contacts wall 116 to compress wall 116 against rib 108.

While the invention has been described with respect to a preferred embodiment, it is to be clearly understood by those skilled in the art that the invention is not limited thereto. For example, the invention can be adapted to urge an edge surface of any tape into contact with a reference surface representing a desired spatial orientation of the tape as the tape is moved in a predetermined direction and along a predetermined path. Therefore, the scope of the invention is to be interpreted only in conjunction with the appended claims.

The embodiments of the invention in which an exclusive property or privilege is claimed are defined as follows:

1. A print stock guide for printing apparatus, said print stock guide comprising:

(a) a base having a substantially planar reference surface;

(b) a first roller means mounted on said base and having a first peripheral surface which is supported for rotation, in proximity to said reference surface, about an axis which is inclined in a predetermined direction by an angle $\theta$ from a normal drawn to said reference surface;

(c) a second roller means mounted on said base and having a second peripheral surface which is supported for rotation, in proximity to said reference surface, about an axis substantially parallel to said axis of rotation of said first peripheral surface, with at least a portion of said second peripheral surface being in proximity to at least a portion of said first peripheral surface to define a nip therebetween; and, (d) a stock sensor supported in said base in proximity to said reference surface, said stock sensor including: first and second opposing, spaced-apart surfaces defining therebetween a slot which is aligned with said nip of said first and second peripheral surfaces; a light source disposed in said first surface of said stock sensor at a predetermined distance above said reference surface; and, a light sensor disposed in said second surface of said stock sensor at said predetermined distance above said reference surface and in opposing relationship to said light source.

2. A print stock guide as recited in claim 1, further comprising means for selectively adjusting said predetermined distance.

* * * * *

UNITED STATES PATENT AND TRADEMARK OFFICE

CERTIFICATE OF CORRECTION

PATENT NO. : 4,248,151

DATED : February 3, 1981

INVENTOR(S) : Kenneth G. Real

It is certified that error appears in the above-identified patent and that said Letters Patent are hereby corrected as shown below:

Column 1, line 6: delete "the", second occurrence.
Column 1, line 54: delete "proimity" and insert --proximity--.
Column 3, line 4: delete "or" and insert --of--.
Column 3, line 36: after "to", first occurrence, insert --permit the--.

Signed and Sealed this

*Twenty-sixth* Day of *May 1981*

[SEAL]

*Attest:*

RENE D. TEGTMEYER

*Attesting Officer* *Acting Commissioner of Patents and Trademarks*